US005082996A

United States Patent [19]

Takahashi et al.

[11] Patent Number: 5,082,996

[45] Date of Patent: Jan. 21, 1992

[54] SWITCHING MECHANISM IN CIRCUIT BREAKER

[75] Inventors: Tatsunori Takahashi; Makoto Unuma; Naoshi Uchida, all of Kanagawa, Japan

[73] Assignee: Fuji Electric Co., Ltd., Kanagawa, Japan

[21] Appl. No.: 436,871

[22] Filed: Nov. 16, 1989

[30] Foreign Application Priority Data

Nov. 18, 1988 [JP] Japan ..... 63-292054

[51] Int. Cl.[5] ..... H01H 73/02

[52] U.S. Cl. ..... 200/401

[58] Field of Search ..... 200/401

[56] References Cited

U.S. PATENT DOCUMENTS 4,786,771 11/1988 Iio et al. ..... 200/401

FOREIGN PATENT DOCUMENTS 58-223233 12/1983 Japan .

1523407 8/1978 United Kingdom ..... 200/401

*Primary Examiner*—Renee S. Luebke

*Attorney, Agent, or Firm*—Finnegan, Henderson, Farabow, Garrett, and Dunner

[57] ABSTRACT

In a circuit breaker switching mechanism in which when a latch is released by setting a handle lever at the "on" position, a toggle link unit made up of upper and lower links with a center pin therebetween is elastically reversed thereby to trip the circuit breaker, an interfering stopper is held in contact with the periphery of the upper link to limit the operation of the latter thereby to cause the center pin to move straightly when tripped, whereby the period of time required for opening the circuit breaker is minimized.

4 Claims, 3 Drawing Sheets

SWITCHING MECHANISM IN CIRCUIT BREAKER

BACKGROUND OF THE INVENTION

1. Field of the Invention

This invention relates to the switching mechanism of a small circuit breaker.

2. Prior Art

FIG. 5 shows essential components of the switching mechanism of a conventional circuit breaker (or molded-case circuit breaker). In FIG. 5, reference numerals 30 designates a latch; 31, a holder; and 32, a toggle link unit. The latch 30 is rotatably supported at one end by means of a latch pin 33; however, normally it is locked by a trip mechanism 34 at the other end so that it may not be turned. The holder 31 holds a movable contactor 35, and is rotatably supported by a switching shaft 36. The toggle link unit comprises an upper link 37 coupled to the latch 30, and a lower link 38 coupled to the holder 31. The upper link 37 is coupled to the lower link 38 with a center pin 39. One end of a switching spring (not shown) is engaged with the center pin 39 so that the toggle link unit 32 is reversed by the tensile force of the switching spring. Further in FIG. 5, reference numeral 40 designates a stationary contactor.

When the latch 30, the holder 31, the toggle link unit 32, and the center pin 39 are positioned as indicated by the solid lines in FIG. 5, the circuit breaker is in the "on" state; and, when the circuit breaker is tripped, they are positioned as indicated by the two-dot chain lines. When, with the circuit breaker in the "on" state, an overcurrent trip device (not shown) operates to disengage the latch 30 from the trip mechanism, the latch 30 is turned counterclockwise by the elastic force of the switching spring (not shown) through the toggle link unit 32. In this operation, whenever the elastic force goes over the dead point the toggle link unit 32 is reversed. As a result of this occurrence the circuit breaker is tripped as indicated by the two-dot chain lines in FIG. 5.

In FIG. 5, reference characters $P_1$, $P_2$ and $P_3$ designate the points where the center pin 39 is positioned during the tripping operation of the circuit breaker. More specifically, $P_1$ is an "on" position, $P_2$ is a beyond-dead-point position, and $P_3$ is a trip position. Further in FIG. 5, reference character M designates the locus of the center pin 39 from the position $P_1$ to the position $P_3$. The locus is a curve as shown in FIG. 5, and analysis has proven that it is a combination of curves of different radii.

Improvement of the performance of the circuit breaker resides in reducing the period of time required for opening the circuit breaker as much as possible. For this purpose, the locus of the position $P_1$ to the position $P_3$ should be a straight line instead of a curve. That is, if the locus M is a straight line, the center pin 39 goes the shortest distance between the two positions $P_1$ and $P_3$; that is, the circuit breaker will be opened in the shortest time.

SUMMARY OF THE INVENTION

In view of the foregoing, an object of this invention is to provide a switching mechanism for a circuit breaker in which, when the circuit breaker is tripped, the center pin of the toggle link unit is moved in a straight line from the "on" position to the trip position, thereby minimizing the period of time required for opening the circuit breaker.

The foregoing object and other objects of the invention have been achieved by the provision of a switching mechanism for a circuit breaker comprising: a latch which is swingably supported at one end portion, and has the other end portion which is normally engaged with a tripping mechanism so as to prevent the latch from being swung; a holder rotatably supported by a switching shaft, the holder having a movable contactor; a toggle link unit including an upper link coupled to the latch, and a lower link coupling to the holder; a swinging handle lever with an operating handle; and a switching spring connected between the handle lever and a center pin through which the upper link of the toggle link unit is coupled to the lower link, in which, when the handle lever is set at an "on" position to release the latch, the tensile force of the switching spring goes beyond the dead point with respect to the toggle link unit, thus reversing the toggle link unit, thereby tripping the circuit breaker, which, according to the invention, further comprises: an interfering stopper disposed in contact with the periphery of the upper link of the toggle link unit so as to limit the operation of the upper link when the toggle link unit is reversed thereby moving the center along a straight line when the circuit breaker is tripped.

In the switching mechanism of the invention, the interfering stopper is held in contact with the periphery of the upper link of the toggle link unit to limit the operation of the upper link thereby causing the center pin of the toggle link unit to move along a straight line. The straight movement of the center link ca be realized by suitably defining the contour of the interfering stopper, which is in contact with the upper line, according to the dimensions of the latch, the toggle link unit, and the holders forming the switching mechanism.

The nature, principle and utility of the invention will become more apparent from the following detailed description when read in conjunction with the accompanying drawings.

DETAILED DESCRIPTION OF THE PREFERRED EMBODIMENTS

One example of a switching mechanism in a circuit breaker according to the invention will be described with reference to FIGS. 1A and 1B.

Figure 1A:
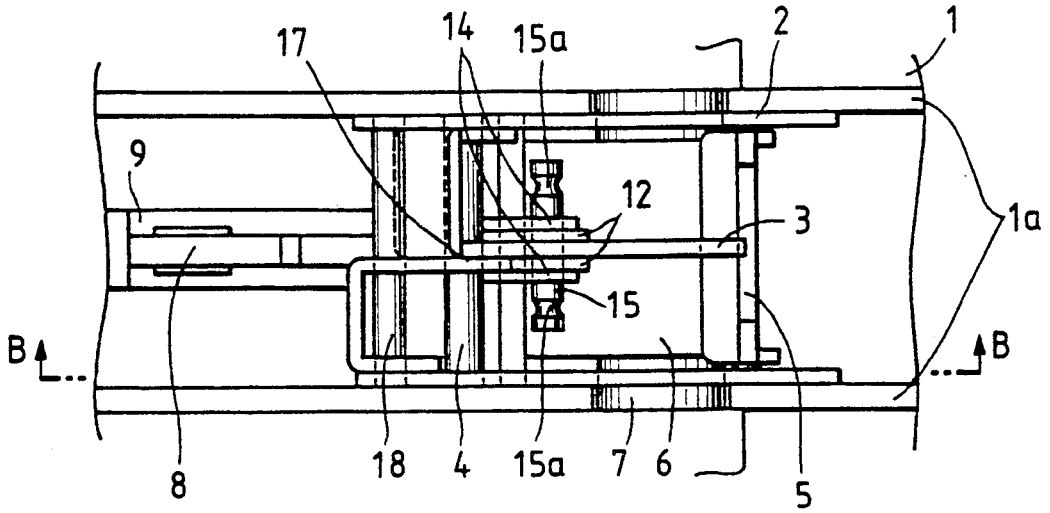
FIG. 1A is a plan view showing a switching mechanism in a circuit breaker according to this invention.
Figure 1B:
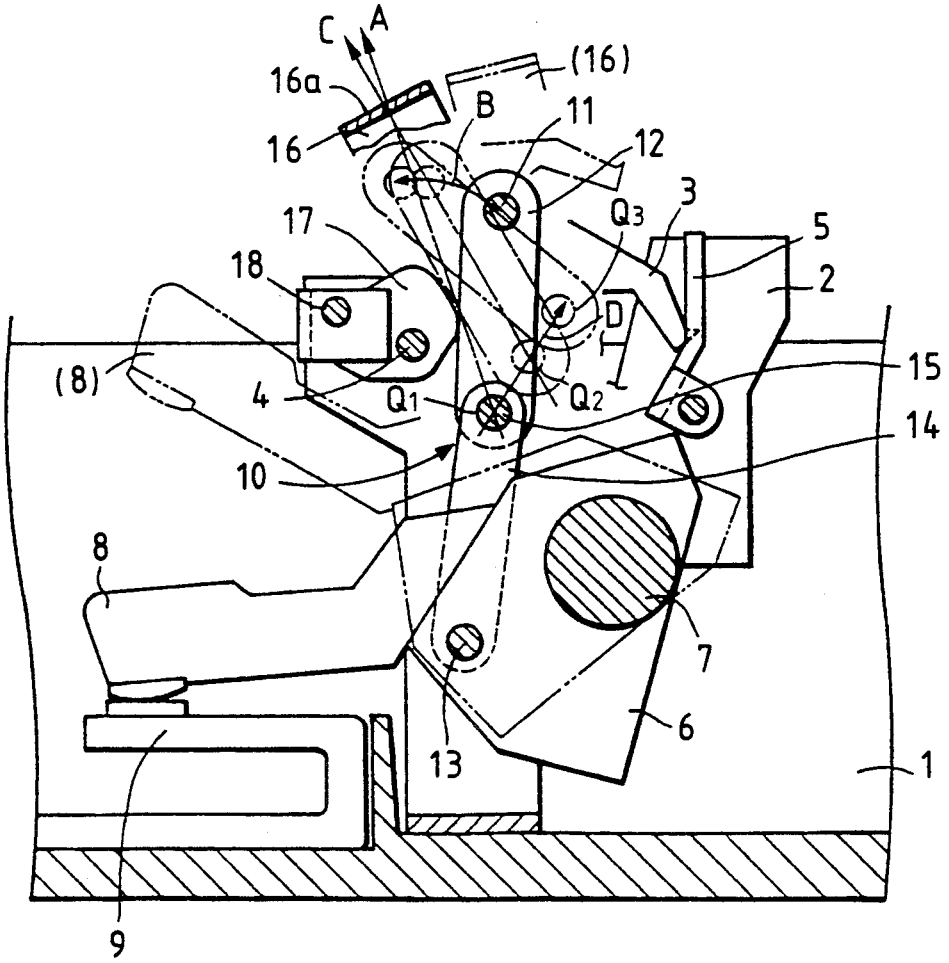
FIG. 1B is a sectional diagram taken along line B-B in FIG. 1*a;*

In FIGS. 1A and 1B, reference numeral 1 designates a molded case for a circuit breaker. The molded case 1 has two walls 1a arranged in parallel with each other, which define the central pole region of the circuit breaker. In the central pole region, a frame 2 having right and left side plates is mounted in such a manner that the right and left side plates are extended along the walls 1*a*, respectively. The frame 2 thus mounted supports the components of the switching mechanism.

Further in FIGS. 1A and 1B, reference numeral 3 designates a latch. The base end portion of the latch 3 is U-shaped. The latch 3 is rotatably supported by the frame 2 through a latch pin 4 with the base end portion extended along one of the side plates of the frame 2. Normally, the front end portion of the latch is locked by a trip mechanism 5 supported by the frame 2 so that the latch may not be turned (only the latch receiving part of the trip mechanism 5 is shown).

The circuit breaker has a holder 6 made of insulating material. The holder 6 is coupled to the right and left pole regions of the circuit breaker through a switching shaft 7 which is molded integral with the holder. A movable contactor 8 is secured to the holder 6 with pins (not shown), and it is urged counterclockwise by a contact spring (not shown) so that it is normally in contact with a stationary contactor 9.

Further in FIGS. 1A and 1B, reference numeral 10 designates a toggle link unit which comprises an upper link 12 coupled to the latch 3 with a pin 11, and a lower link 14 coupled to the holder 6 with a pin 13. The upper link 12 is coupled to the lower link 14 with a center pin 15. Each of the links 12 and 14 is in the form of a two-prong fork. The latch 3 is held between the two prongs of the upper link 12, which are then held between the two prongs of the lower link 14.

In FIG. 1B, reference numeral 16 designates a U-shaped handle lever with two legs. The handle lever 16 is swingably supported with the front end portions of the legs engaged with grooves formed in the two side boards of the frame 2. An operating handle (not shown) is mounted on the upper U- shaped bent portion 16*a* of the handle lever 16. Switching springs are connected between the U-shaped bent portion 16*a* and both ends 15*a* of the center pin 15.

An interfering stopper 17, whose base end portion is bent U-shaped to form two legs, is inserted between the latch 3 and the other side board of the frame 2, and fixed with a pin 18 and the latch pin 4. One of the two legs of the interfering stopper 17 is longer than the other, and its end portion has a predetermined contour which is brought into contact with the periphery of the upper link 12. The interfering stopper 17 has an additional function of positioning the latch 3 in the lateral direction (i.e., in the direction of the axis of the latch pin 4).

Figure 2:
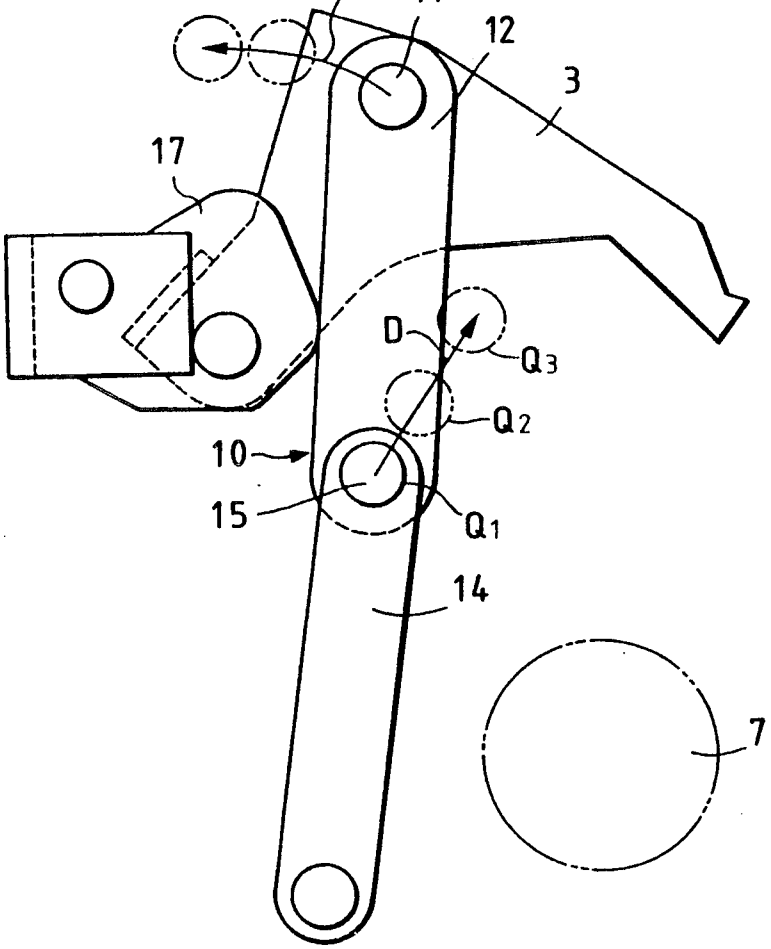
Figure 5:
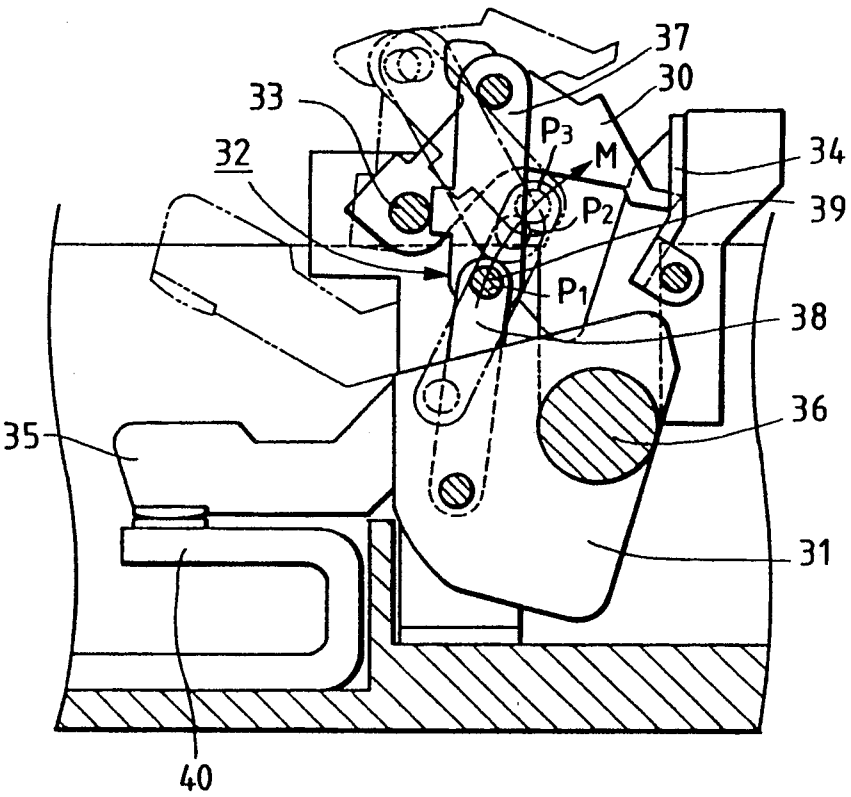
FIG. 5 PRIOR ART
FIG. 5 is a side view showing a conventional switching mechanism in a circuit breaker.

In FIG. 2, the solid lines indicate that the circuit breaker is in the "on" state, and the two-dot chain lines indicate the position of the center pin of the circuit breaker in the "off (trip)" state, and the one-dot chain line indicates the position of the upper link 12 when the switching springs (not shown) go over the dead point with respect to the toggle link unit 10.

When the circuit breaker is in the "on" state as indicated by the solid lines, the center pin 15 of the toggle link unit 10 is urged in the direction of the arrow A (in FIG. 1B) by the elastic force of the switching springs (not shown) so as to turn the upper link clockwise about the pin 11. As a result, the upper link 12 is pushed against the interfering stopper 17, and thus is positioned as shown in FIG. 1B.

When, under this condition, an overcurrent trip device (not shown) is operated to release the trip mechanism 5, the latch 3 is turned counterclockwise about the latch pin 4 by the elastic force of the switching springs which act on the latch 3 through the pin 11 which couples the upper link 12 to the latch 3. As a result, the pin 11 is moved along an arc B whose center is at the latch pin, while the upper link 12 is moved to the position indicated by the one-dot chain line while being guided by the interfering stopper 17. In this operation, the elastic force of the switching springs acts in the direction of the arrow C in FIG. 1B passing through the center of the pin 11. This point is the dead point of the elastic force of the switching springs with respect to the toggle link unit 10.

When the latch 3 is further turned beyond the dead point, the action of the elastic force of the switching springs is reversed. As a result, the upper link 12 is turned counterclockwise with respect to the pin 11; that is, it is caused to leave the interfering stopper, thus being quickly moved to the positioned indicated by the two-dot chain line. Thus, the circuit breaker has been opened. In this operation, the handle lever 16 is moved to the position indicated by the two-dot chain line, and the display surface of the operating handle (not shown) indicates that the tripping operation has been accomplished. When the circuit breaker is in "trip" state, the latch 3 and the holder 6 are held at the stop position by a stopper (not shown), whereby the center pin 15 is also held at the trip position.

Figure 3:
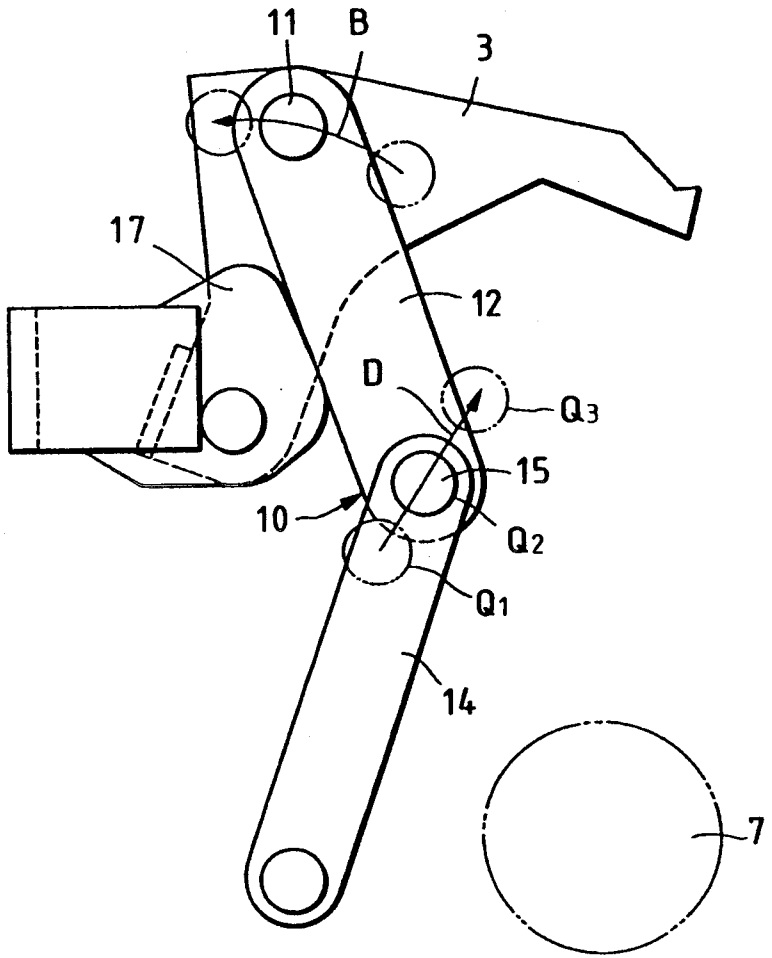
FIGS. 2, 3 and 4 are side views showing a latch and a toggle link unit forming the switching mechanism which are located at an "on" position, a beyond-dead-point position, and a trip position, respectively.
Figure 4:
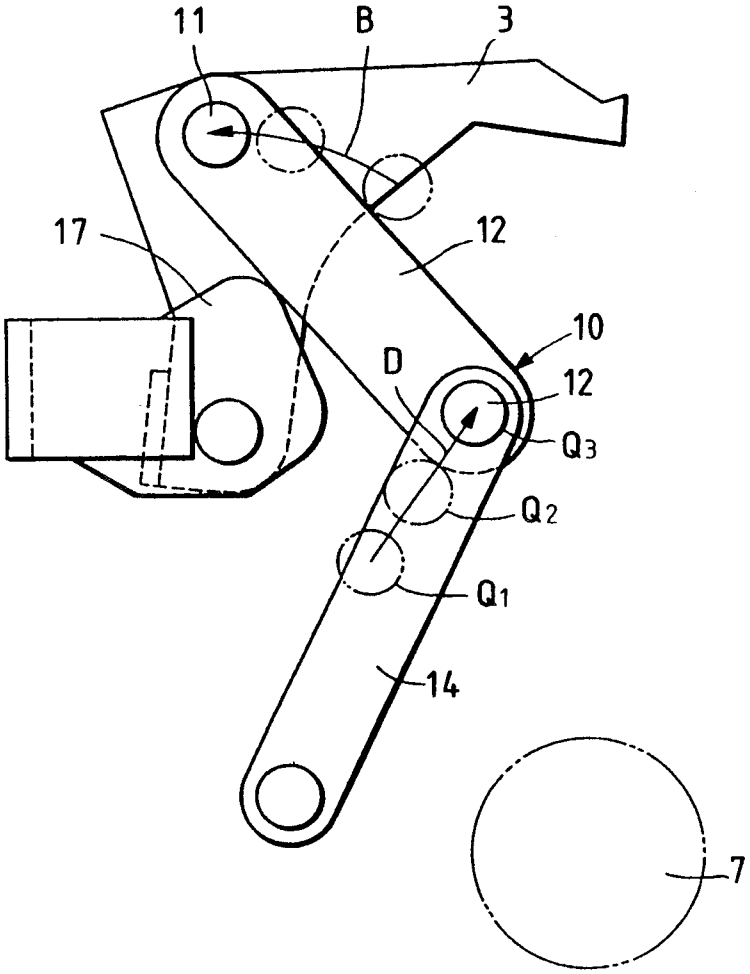

In FIG. 1B, reference characters $Q_1$, $Q_2$ and $Q_3$ designate the points where the center pin 15 is positioned in the above-described tripping operation. More specifically, the point $Q_1$ is an on position, the point $Q_2$ is a beyond-dead-point position, and the point $Q_3$ is a trip position. Further in FIG. 1B, the arrow D indicates the locus of the center pin 15 from the point $Q_1$ to the point $Q_3$. At the above-described three positions, the latch 3 and the toggle link unit 10 are as shown in FIGS. 2, 3 and 4, respectively. As shown in these figures, the locus D of the center pin 15 is a straight line. This attributes to the fact that, while the upper link 12 is moved from the "on" position to the beyond-dead-point position, it is prevented from being shifted to the left by the interfering stopper.

The period of time required for opening the circuit breaker depends on the operation of the center pin 15. With the circuit breaker of the invention, the locus of the center pin moved in the tripping operation of the circuit breaker is straight; that is, the distance of movement of the center pin is shorter than that in the conventional circuit breaker in which the locus of the center pin is a curve as was described above. Accordingly, with the circuit breaker of the invention, the period of time required for opening is greatly reduced.

As was described above, in the circuit breaker according to the invention, the locus of the center pin of the toggle link unit is a straight line; that is, the period of time required for the center pin to move from the "on" position to the trip position is minimized, and according the period of time required for opening the circuit breaker is greatly reduced.

While there has been described a preferred embodiment of the invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. A switching mechanism in a circuit breaker, comprising:

latch means having two end portions;

latch pin means for swingably supporting one end portion of said latch means;

tripping means for normally locking the other end portion of said latch means to prevent said latch means from being swung;

stationary contactor means;

holder means for holding a movable contactor;

switching shaft means for rotatably supporting said holder means;

toggle link means including an upper link coupled to said latch means, and a lower link coupled to said holder means;

handle lever means with an operating handle, said handle lever means being swingable;

center pin means for coupling said upper link of said toggle link means to said lower link thereof;

switching spring means for connecting between said center pin means and said handle lever means and for providing a tensile force therebetween, wherein when said handle lever means is set at an "on" position to release said latch means, the tensile force of said switching spring means goes beyond the dead point with respect to said toggle link means to reverse said toggle link means, thereby tripping said circuit breaker; and interfering stopper means disposed in contact with said upper link of said toggle link means for limiting the operation of said upper link when said toggle link means is reversed so that said center pin means is moved along a straight line when said circuit breaker is tripped.

2. The switching mechanism according to claim 1, in which said interfering stopper means is U-shaped.

3. The switching mechanism according to claim 2, in which said interfering stopper means has two legs, one of which is longer than the other thereof, an end portion of said longer leg having an edge which is brought into contact with said upper link.

4. The switching mechanism according to claim 1, wherein said links move in a plane and wherein said interfering stopper means is arranged to position said latch means in the plane of movement of said links.

* * * * *